US008562028B2

(12) United States Patent
Smith et al.

(10) Patent No.: US 8,562,028 B2
(45) Date of Patent: Oct. 22, 2013

(54) CONNECTOR ASSEMBLY

(75) Inventors: André M. Smith, Lier (NO); Bengt Dahlborg, Charlottenberg (SE)

(73) Assignee: Aker Subsea AS, Lysaker (NO)

( * ) Notice: Subject to any disclaimer, the term of this patent is extended or adjusted under 35 U.S.C. 154(b) by 8 days.

(21) Appl. No.: 13/139,135

(22) PCT Filed: Dec. 23, 2009

(86) PCT No.: PCT/EP2009/067877
§ 371 (c)(1),
(2), (4) Date: Jun. 10, 2011

(87) PCT Pub. No.: WO2010/081621
PCT Pub. Date: Jul. 22, 2010

(65) Prior Publication Data

US 2011/0241335 A1 Oct. 6, 2011

(30) Foreign Application Priority Data

Jan. 16, 2009 (NO) ..... 20090253

(51) Int. Cl.
*F16L 21/06* (2006.01)

(52) U.S. Cl.
USPC ..... 285/322; 285/34

(58) Field of Classification Search
USPC ..... 285/322, 34, 33, 323, 920, 35
See application file for complete search history.

(56) References Cited

U.S. PATENT DOCUMENTS

| | | | | |
|---|---|---|---|---|
| 4,433,859 | A | 2/1984 | Driver et al. | |
| 4,696,493 | A * | 9/1987 | Brammer | 285/3 |
| 5,163,514 | A * | 11/1992 | Jennings | 166/368 |
| 5,542,475 | A * | 8/1996 | Turner et al. | 166/387 |
| 6,102,626 | A | 8/2000 | Milberger | |
| 6,129,149 | A | 10/2000 | Beall | |
| 6,336,508 | B1 | 1/2002 | Guinn | |
| 6,554,324 | B1 * | 4/2003 | Herman | 285/322 |
| 6,666,272 | B2 * | 12/2003 | Singeetham et al. | 166/345 |
| 8,127,853 | B2 * | 3/2012 | Pallini et al. | 166/345 |
| 2004/0099420 | A1 | 5/2004 | Kotrla et al. | |
| 2006/0157236 | A1 | 7/2006 | Walker et al. | |

FOREIGN PATENT DOCUMENTS

| | | |
|---|---|---|
| GB | 2362906 | 12/2001 |

OTHER PUBLICATIONS

Morrish, Susan, "International Search Report" for PCT/EP2009/067877 as mailed Aug. 20, 2010, 4 pages.

* cited by examiner

*Primary Examiner* — Aaron Dunwoody
(74) *Attorney, Agent, or Firm* — Winstead PC

(57) ABSTRACT

A connector assembly for connection to a tubular element. The connector assembly includes locking elements with locking profiles, movable in a locking and an unlocking direction. The locking profiles can lock with facing locking profiles of the tubular member. The locking elements can be moved in the locking direction as a result of movement of an activation sleeve in a first direction. The locking elements or the activation sleeve include guiding elements that are adapted to slide against inclined unlocking guiding surfaces of the activation sleeve or the locking elements. Movement of the activation sleeve in a second direction results in movement of the locking element in the unlocking direction. The activation sleeve has axially extending activation sleeve protrusions having spaces formed between them.

14 Claims, 9 Drawing Sheets

CONNECTOR ASSEMBLY

The present invention generally relates to an assembly for locking to the locking profiles of a tubular shaped member. More particularly the invention relates to such an assembly with easily replaceable locking members.

BACKGROUND

Particularly in the field of subsea wells, one can find a plurality of devices for coaxially joining large tubular members.

A well known solution is to arrange a split ring with radially arranged locking profiles and an inclined face. When forcing an activation sleeve against the inclined face, the split ring will move radially into a facing locking profile. In such a solution, the split ring will change its shape when being moved. Thus, some of the force from the activation sleeve will be used for this change of shape. Furthermore, the ring will be arranged with inherent tension when moved by the activation sleeve. In addition, a severe problem can arise if the split ring does not fully retract to its original shape during release. In such case, it may interfere with moving parts and prevent proper function.

Another solution is shown in patent publication U.S. Pat. No. 6,129,149, which describes a wellhead connector for connecting a wellhead Christmas tree assembly to a wellhead. This connector comprises a plurality of dogs adapted to be forced radially against facing locking profiles of the wellhead. Furthermore, the dogs can be forced in both radial directions by means of a first and a second drive means. The solution described in U.S. Pat. No. 6,129,149 occupies much radial space and seems to be suited only for locking to the outwardly facing profiles of a tubular member, unless the inner diameter of the tubular member is particularly large.

An object of the present invention is to provide a connector assembly which can be used to connect to inner profiles of a tubular member, and which does not need to alter the shape of any components during connection or disconnection. As will appear from the following disclosure, this is achieved with the connector assembly according to the invention, along with other advantageous features. As will appear from the following descriptions, the connector assembly is, however, not restricted to being connected to inner profiles, as it indeed can be designed for connection to outer profiles of a tubular member.

THE INVENTION

According to the invention, there is provided a connector assembly for connection to a tubular element, the assembly comprising a plurality of locking elements which are movable in a locking and an opposite unlocking direction, the locking elements comprising locking profiles adapted for locking engagement with facing locking profiles of said tubular member. The invention is characterized in that said plurality of locking elements are adapted to be moved in a locking direction as a result of movement of an activation sleeve in a first direction, wherein the movement in the locking direction is obtained as a result of a part of the locking element or the activation sleeve sliding against an inclined locking surface of the other. Furthermore, said plurality of locking elements or said activation sleeve comprise guiding elements which are adapted to slide against inclined unlocking guiding surfaces of the activation sleeve or the locking elements, respectively, wherein a movement of the activation sleeve in a second direction results in a movement of the locking element in an unlocking direction, as the inclined unlocking guiding surfaces exhibit an inclination to said first and second directions, as well as to said locking and unlocking directions. The activation sleeve comprises axially extending activation sleeve protrusions which have spaces between them. In addition, (a) the locking elements comprise side walls defining a void between them, wherein said activation sleeve protrusions extend into said voids of the locking elements; or (b) said locking elements are arranged between said activation sleeve protrusions.

Preferably, the locking and unlocking directions are parallel and crosswise to said first and second directions, which are also parallel. The term crosswise shall be conceived as non-parallel, and is not restricted to the meaning of the term perpendicular. In a preferred embodiment however, the locking and unlocking directions are perpendicular with respect to the first and second directions.

In an embodiment of the invention, the locking elements comprise side walls which define a void or space between them. In this embodiment, the activation sleeve comprises axially extending activation sleeve protrusions having spaces between them, wherein the activation sleeve protrusions extend into said voids of the locking elements. Preferably, side flanges of the locking elements can then be arranged in the spaces between the activation sleeve protrusions.

The inclined unlocking guiding surfaces or an extension of these are preferably interrupted by an absence of surface, so that the locking element can be pulled past the guiding element and out of engagement with the connector assembly, when the guiding element faces this absence of surface. In this way, the locking elements can be removed easily from the connector assembly without cumbersome dismantling. As will become apparent from a more detailed description with reference to the appending drawings, the locking elements can be pulled right out of the assembly when the activation sleeve is in the proper position, even without any tools or equipment.

Preferably, the activation sleeve has inclined locking surfaces with an inclination to said first direction and said locking direction, wherein said inclined locking surfaces are adapted to slide against facing inclined locking surfaces of the locking elements when the activation sleeve is moved in the first direction. Thereby a movement of the locking element in the locking direction is provided when the activation sleeve is moved in the first direction. The inclined locking surfaces of the locking elements extend preferably across a substantial part of the locking element, across the locking direction. Also preferably, the surfaces extend across a centre part of the locking element. However, each locking element can also comprise a plurality of inclined locking surfaces, arranged with a distance to each other. As will be appreciated by a person skilled in the art, however, a large surface will facilitate a large force on the locking element in the locking direction.

The inclined locking surfaces of the locking elements can be continued and deflected to second holding surfaces which are substantially perpendicular to the locking and unlocking directions. The activation sleeves can exhibit first holding surfaces adapted to abut against said second holding surfaces when the locking elements are in a locked position. Such abutting holding surfaces are preferably large and will preferably not transfer forces in the first or second direction between the locking elements and the activation sleeve, once properly arranged in the locked position. This is due to their extension being perpendicular to the locking and unlocking directions.

Furthermore, the first holding surface and second holding surface can be arranged to maintain a pre-tension of the locking element towards the locking direction when in the locked position. Also, at least one pre-tension transition surface can advantageously be arranged as a transition surface between said inclined locking surfaces and said second or first holding surface, respectively. The pre-tension transition surface is preferably arranged such that pre-tension is at least partially released before the guiding elements enter into engagement with the unlocking guiding surfaces, when the activation sleeve is moved in the second direction in order to unlock the locking elements.

It should be noted that said surfaces are not necessarily strictly plane surfaces. For instance, the pre-tension transition surfaces may be curved. Also, instead of an edge defining the transition between various surfaces, there may be arranged rounded surfaces in order to provide less wearing of the abutting parts.

The activation sleeve can comprise a plurality of pre-tension surfaces or pre-tension transition surfaces adapted to enter into sliding contact with facing pre-tension transition surfaces of the locking elements as the activation sleeve is moved further in the first direction after having moved said locking elements into a position where their locking profiles are in engagement with facing locking profiles of the tubular element. This further movement in the first direction results in that said pre-tension transition surfaces of the activation sleeve slide against said pre-tension transition surfaces of the locking members. This will further result in a pre-tension compression force between said activation sleeve and said locking elements, as the locking elements will be clamped between the activation sleeve and the tubular element.

In a further embodiment of the connector assembly according to the present invention, it preferably comprises pre-tension transition surfaces on the activation sleeve and the locking elements, which are adapted to provide pre-tension of the locking elements in the locking direction as said pre-tension transition surfaces slide against each other when the locking sleeve is moved in the first direction. In this embodiment, the pre-tension transition surfaces exhibit an angle of inclination which is between and different from the corresponding angles of said inclined locking surfaces and said first direction. Due to this, one can obtain a large pre-tensioning force in the locking direction. This will become more apparent through the more detailed description of an example embodiment further below.

The term tubular, as used above, shall not be confined to mean concentric circular shapes. Instead, tubular includes various circular shapes, such as an elliptical shape, as well as polygonal shapes, such as a square or rectangular shape. That is, the connector assembly according to the present invention is suited for connection to pipe elements having for instance a rectangular or elliptical cross section.

The locking profiles on the locking elements can be any kind of shape or form adapted to engage with a facing shape or form in order to create a locking effect against mutual movement between the two shapes or forms, as will be appreciated by a person skilled in the art.

All of the guiding elements can preferably be attached to a common actuation sleeve. Thus, by moving one actuation sleeve, all the locking elements can be actuated simultaneously.

A preferred application of the wellhead connector assembly according to the invention is as a locking assembly of an internal tree cap, arranged for being releasably connected to an inner locking profile of a Xmas tree spool.

Another preferred application is the use of the connector assembly according to the invention with a ultra high pressure tubing hanger.

The connector assembly is particularly useful for applications in connection with deepwater subsea wells. Due to its structure, particularly solid locking elements can be used, a feature which make the connector assembly applicable for high pressure applications in deep waters, for instance for pressures of 15-20 000 psi. Depending on the dimensioning of the assembly, it can also be used at even higher pressures.

EXAMPLE

In order to illustrate the various features of the present invention more thoroughly, an example of embodiment will be given in the following with reference to the drawings, in which FIG. 1 is a perspective cutaway view of an internal tree cap (ITC) with a connector assembly according to the present invention;

Figure 1:
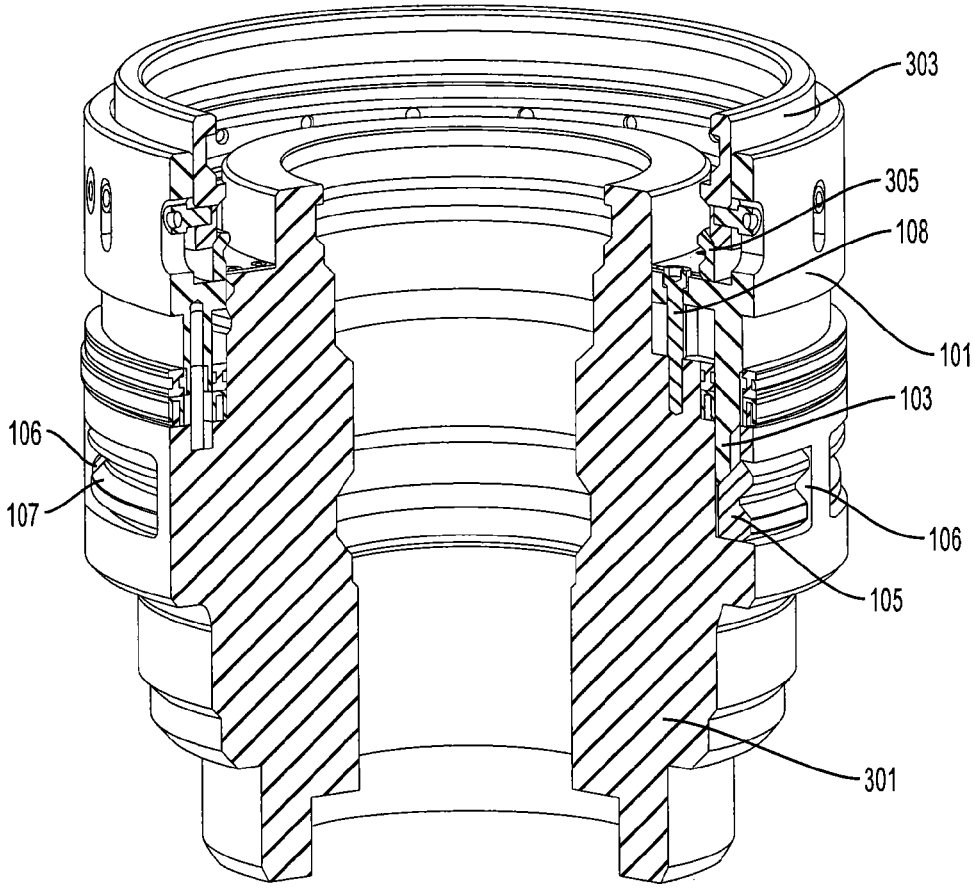

FIG. 1 shows an internal tree cap (ITC) 301 with a connector assembly according to the invention, arranged for being locked to the inner locking profiles of a tree spool. In this embodiment, the connector assembly is integrated with the main body of the ITC 301. For releasable locking to the tree spool, the connector assembly has a plurality of locking elements in the form of locking dogs 105. The locking dogs 105 are adapted to be forced radially outwards with a downward movement of an activation sleeve 101. Furthermore, the locking dogs 105 are arranged in windows 106 in the ITC 301, thereby being supported in the axial and tangential direction.

The activation sleeve 101 is fastened to the ITC 103 main body with a first set of bolts 108 in such a way that it can move reciprocally in a certain distance in the axial direction.

By connecting a tool (not shown) to the upper end of the assembly shown in FIG. 1, the activation sleeve can be actuated. The tool can connect to the assembly by means of the ring 303 and the locking ring 305.

Figure 2:
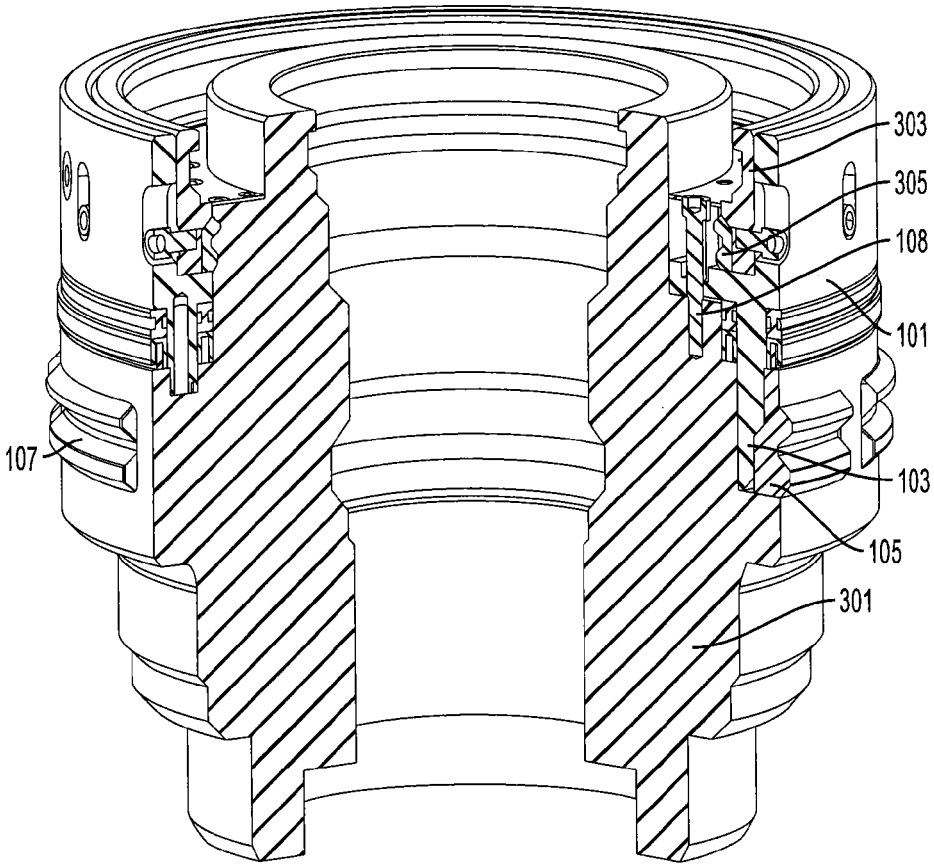
FIG. 2 is the same view as in FIG. 1, with the connector assembly in a locked position.

FIG. 2 shows the same illustration as FIG. 1, however with the activation sleeve 101 forced axially downwards. This movement has led to a radially outward movement of the locking dogs 105. The functioning of this will appear from the following explanation.

Figure 3:
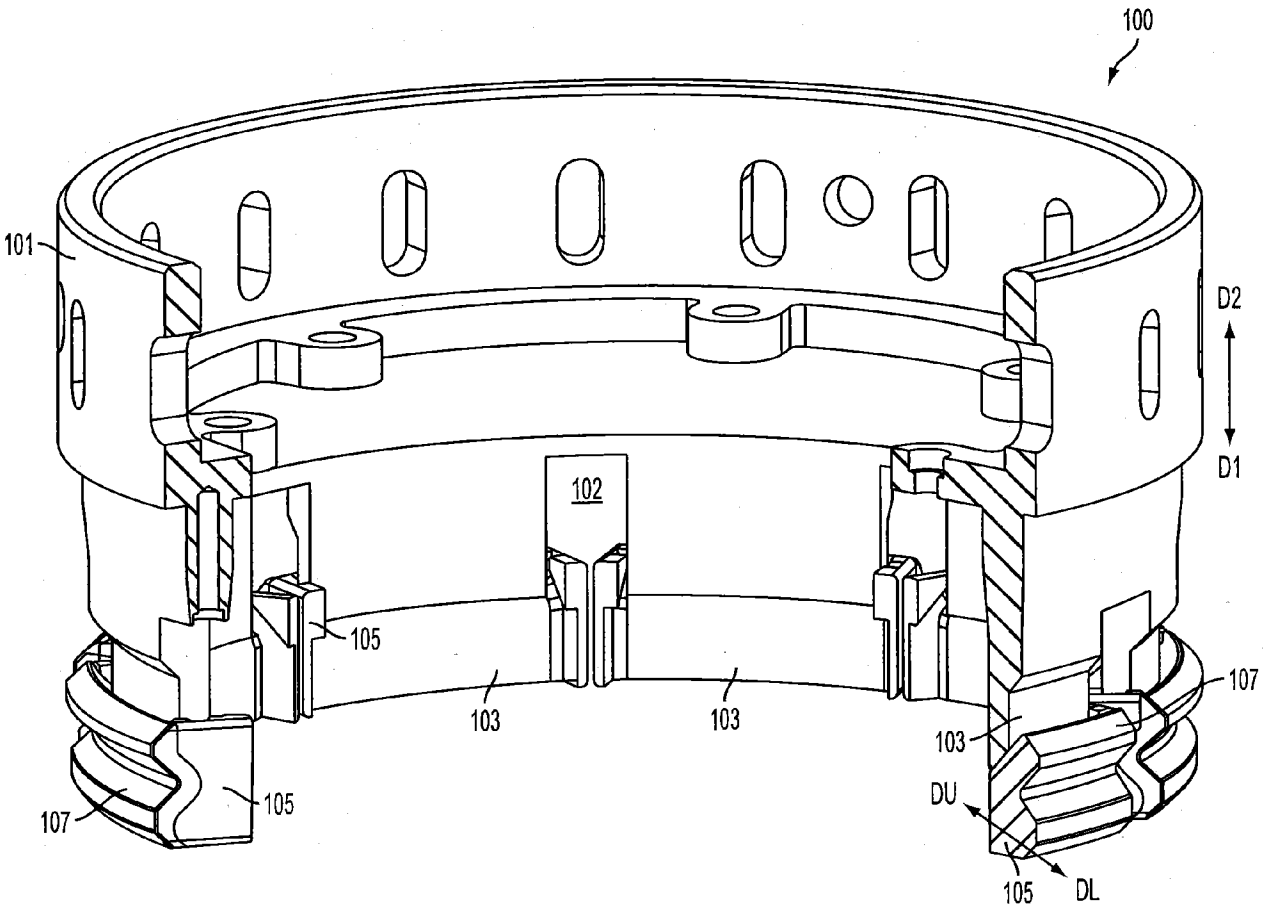
FIG. 3 is a perspective cutaway view of parts of a connector assembly according to the invention, shown in an unlocked state.

FIG. 3 shows part of the embodiment described above without the ITC 301. The lower end of the activation sleeve 101 is divided into activation sleeve protrusions 103. The activation sleeve protrusions 103 are axially extending elongations of the activation sleeve 101 with spaces or cut-outs 102 between them. In this embodiment, the activation sleeve protrusions 103 are equidistantly arranged along the periphery of the activation sleeve 101.

The locking dogs 105 has outwardly facing locking profiles 107, adapted to engage with internally facing locking profiles inside the bore of a tree spool (not shown).

Figure 4:
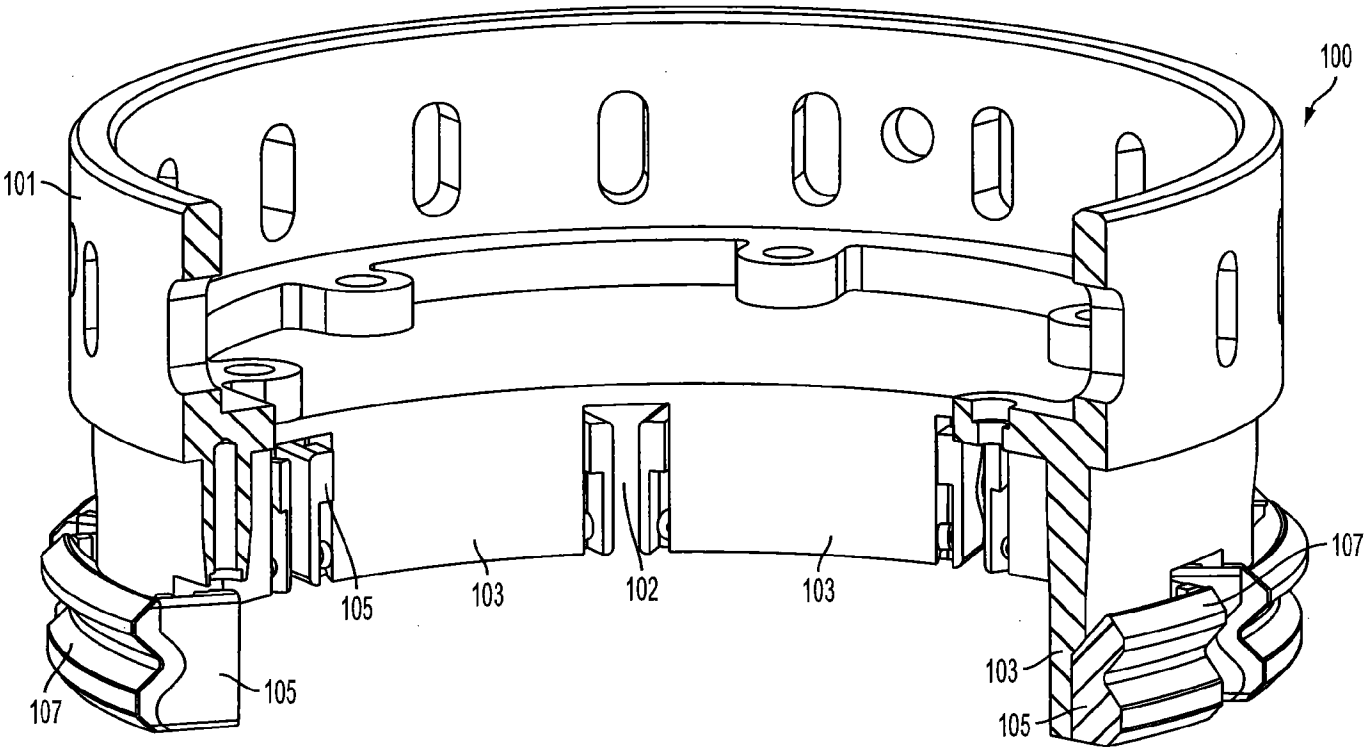
FIG. 4 is the same perspective cutaway view as FIG. 3, shown in a locked state.

In FIG. 3, the locking dogs 105 are shown in a retracted, unlocked position. In FIG. 4, however, the activation sleeve 101 is shown in an axially lower position and the locking dogs 105 have moved to an outer, locking position.

For the sake of clarity, a first and second direction D1, D2 are illustrated in FIG. 3, representing the downward and upward movement of the activation sleeve 101. Furthermore, a locking direction DL and an unlocking direction DU of the locking dogs 105 are also illustrated, referring to their radially outward and inward movement for locking and unlocking, respectively.

In FIG. 4, the view of FIG. 3 is shown with the activation sleeve 101 in a lower position, i.e. it has moved in the first direction D1. Furthermore, the locking dogs 105 have moved radially in the locking direction DL.

Figure 5:
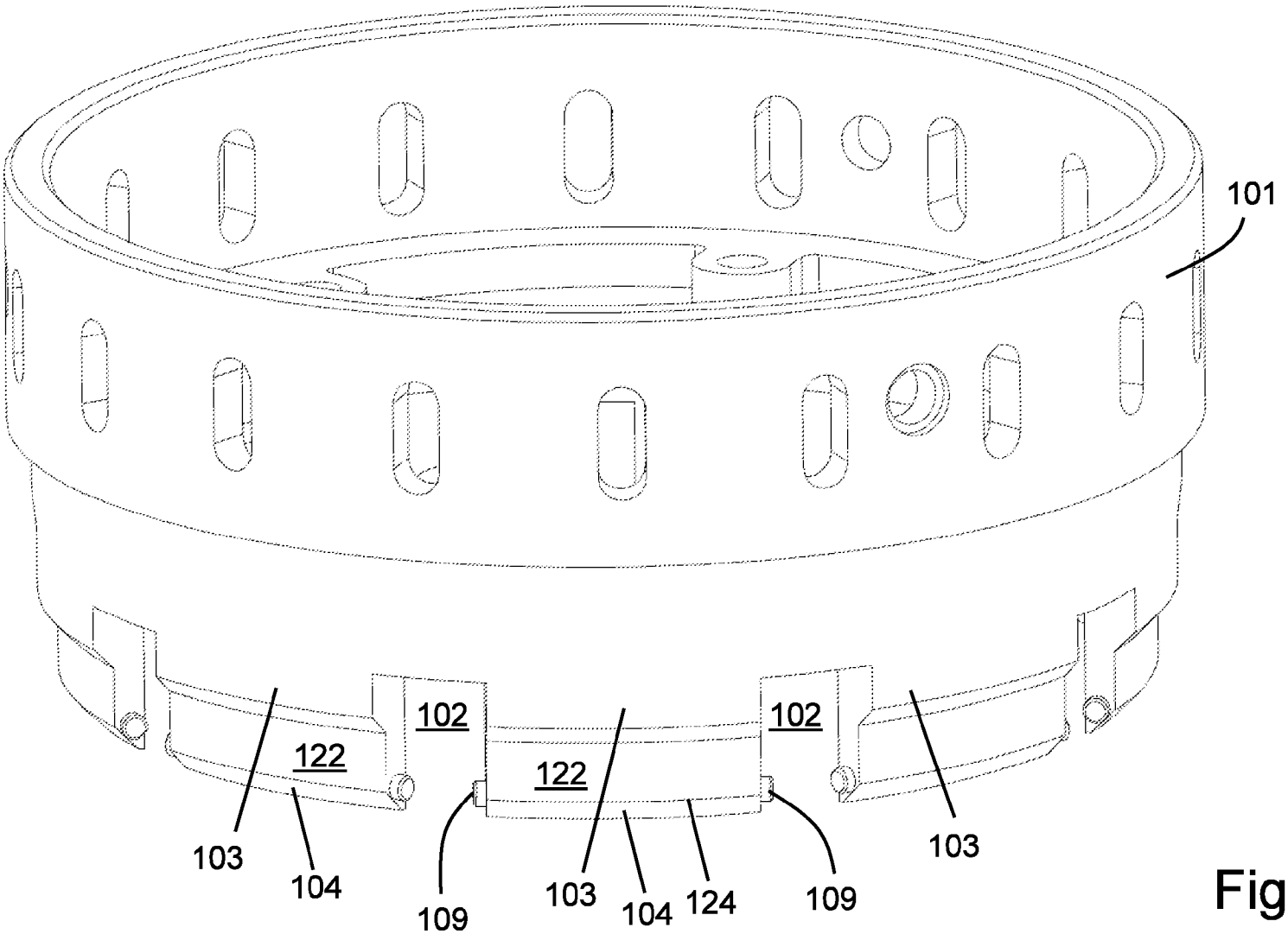
FIG. 5 is a perspective view showing an activation sleeve.

FIG. 5 shows the activation sleeve 101 without the locking dogs 105. In this drawing, one can see a plurality of guiding elements 109 in the form of protrusions which are arranged on the side of the activation sleeve protrusions 103. The guiding elements 109 extend into the spaces or cut-outs 102 between the activation sleeve protrusions 103. Each activation sleeve protrusion 103 is provided with two guiding elements 109, of which one extends into a first cut-out 102 adjacent to the activation sleeve protrusion 103, and the other extends into the oppositely arranged adjacent cut-out 102. Thus, two guiding elements 109 extend into each cut-out 102.

Figure 7:
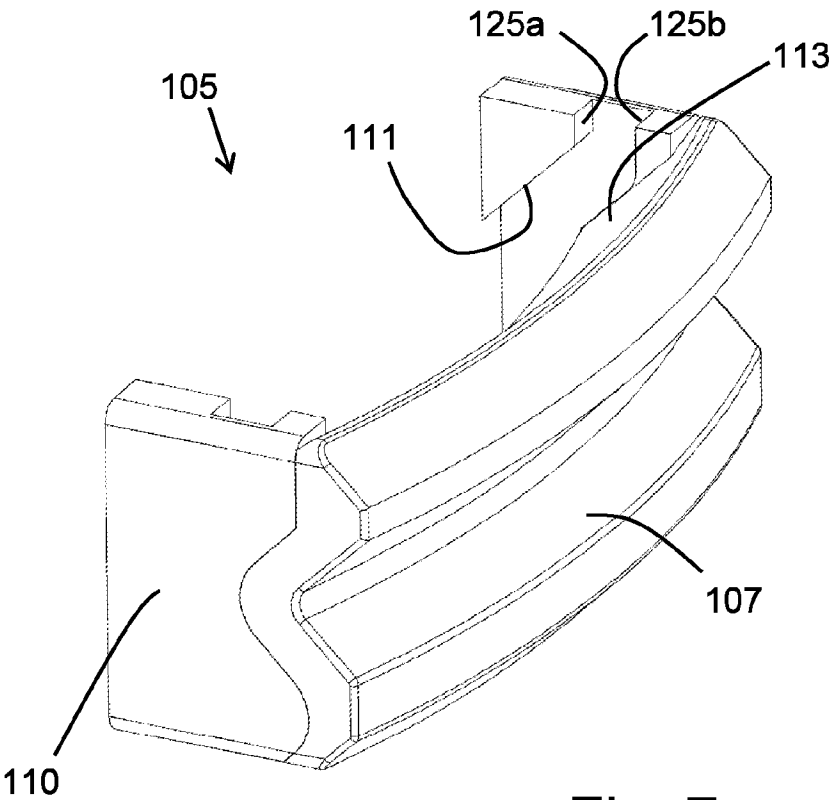
FIG. 7 is a perspective view showing the locking element in FIG. 6 from another angle.
Figure 6:
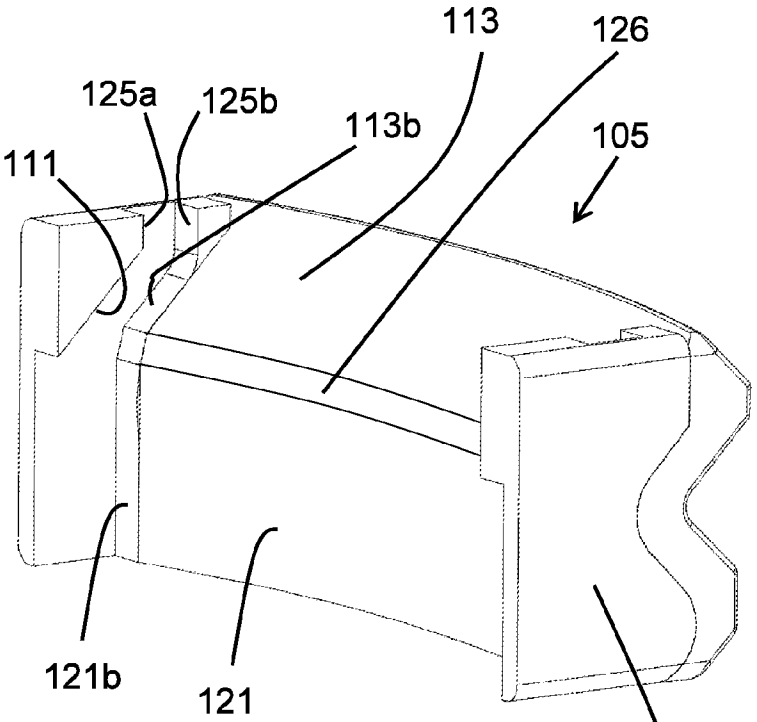
FIG. 6 is a perspective view showing a locking element.

Referring now to FIG. 6 and FIG. 7, the design of the locking dogs 105 will be described in more detail. The locking dog 105 has an inclined unlocking guiding surface 111 and an inclined locking guiding surface 113. The inclined locking guiding surfaces 113 are adapted to slide against an inclined locking surface 104 (FIG. 5) on the activation sleeve 101, when the latter is being moved downwards. This will force the locking dog 105 radially outwards, in the locking direction DL.

When this movement takes place, the guiding elements 109 (FIG. 5) will move in the guiding channel defined between the inclined unlocking surface 111 and the opposite inclined locking surface 113*b*, as well as between a first and a second retaining face 125*a*, 125*b*.

In an alternative embodiment, the inclined locking surface 113 could be omitted, using the guiding elements 109 to move the locking dogs 105 in the locking direction DL by sliding on the narrower inclined locking surface 113*b*. However, one would then not be able to achieve the same amount of force on the locking dogs 105 in the locking direction DL.

Referring to FIG. 6 and FIG. 7, one also sees that the locking dog 105 comprise side walls 110, here in the form of side flanges. The flanges 110 define voids or pockets between them, together with the rest of the locking dog 105, into which the activation sleeve protrusions 103 extend (see FIG. 3).

When the activation sleeve 101 has moved down into its lower position, in the first direction D1, its plurality of first holding surfaces 122 (FIG. 5) will abut against a plurality of second holding surfaces 121 arranged on the locking dogs 105. The first and second holding surfaces 122, 121 are advantageously axial surfaces, being substantially perpendicular to the locking and unlocking directions DL, DU. Thus, once the activation sleeve 101 has moved down to this lower position, any force from the locking dogs 105 onto the activation sleeve 101 in the unlocking direction DU will not result in any force on the activation sleeve 101 in the axial direction, i.e. the first or second directions D1, D2. This will become more apparent when studying FIG. 8 and FIG. 9, as explained further below.

When moving the activation sleeve 101 axially upward, i.e. in the second direction D2, the guiding elements 109 will slide against the inclined unlocking guiding surface 111. This will pull the locking dog 105 radially inward, in the unlocking direction DU. As the force needed to pull the locking dogs 105 in the unlocking direction DU is small, when compared to the possible forces in the locking direction, the relatively narrow surfaces of the inclined unlocking surfaces 113 will be sufficient.

Figure 9:
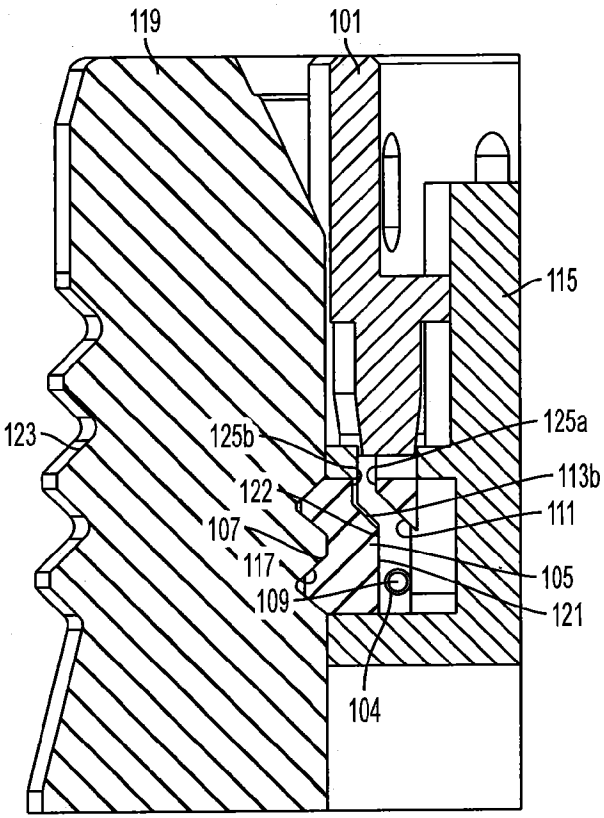
FIG. 9 is the same view as in FIG. 8, wherein the connector assembly has been locked to the internal profiles of a tree spool.
Figure 8:
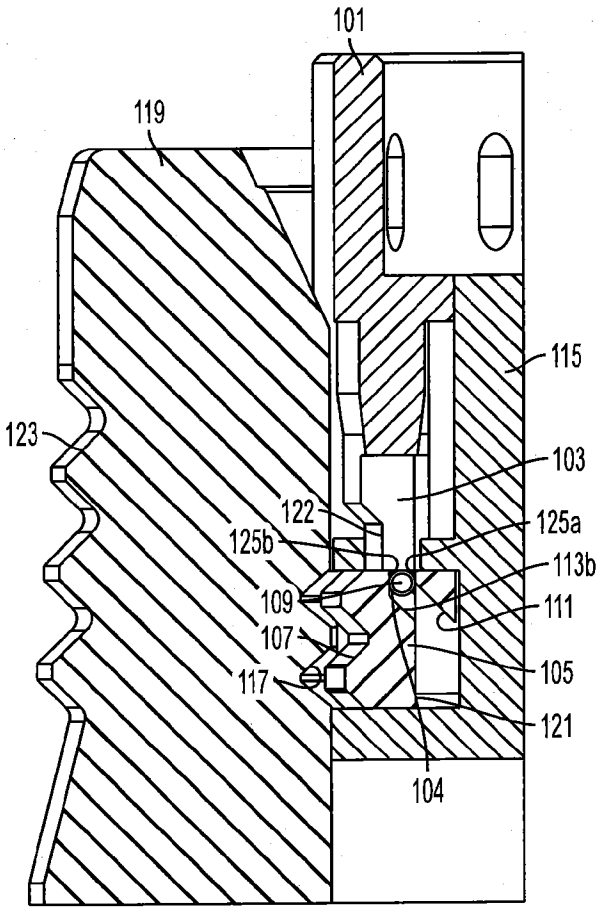
FIG. 8 is an enlarged cross section view showing parts of the connector assembly before locking to the internal locking profiles of a tree spool.

The function of moving the locking dogs 105 in the locking direction DL and the unlocking direction DU is shown more clearly in FIG. 8 and FIG. 9. These figures show cross section views of a dog 105 in an unlocked and a locked position, respectively. In these figures, one can also see a part of the ITC 115. The ITC 115 retains the dogs 105 in their axial position and provides for a radial sliding path for the dogs 105, in the locking and unlocking directions DL, DU. On the left hand side of FIG. 8 and FIG. 9, one can also see a cross section part of a tree spool 119.

As mentioned, in FIG. 8, the dog 105 is in an unlocked or retracted position. In this position it is not in engagement with the internal locking profiles 117 of a tree spool 119. To move the locking profiles 107 of the dog 105 into engagement with the internal locking profiles 117 of the tree spool 119, the inclined locking surface 104 is moved downward in the first direction, sliding against the facing inclined locking surface 113 on the locking dog 105. Since the cross sections shown in FIG. 8 and FIG. 9 run through the side parts of the locking dogs, the cross sections shows the narrow side part 113*b* of the inclined locking surface, and not the larger main part of the inclined locking surface 113.

In FIG. 9, the dog 105 is shown being in locking engagement with the internal profiles 117 of the tree spool 119. In this situation, the activation sleeve 101 has moved to the lower position. In this position the first holding surface 122 of the activation sleeve 101 abuts against the second holding surface 121 of the locking dog 105, as also explained above.

From the situation shown in FIG. 9, by moving the activation sleeve 101 axially upward, the guiding element 109 will eventually meet the inclined unlocking guiding surface 111, thereby pulling the locking dog 105 out of engagement with the tree spool 119. By keeping the guiding element 109 in the position shown in FIG. 8, the dog 105 will be retained in the radial position as shown in FIG. 8. In this position, first and second retaining faces 125*a*, 125*b* are arranged on each side of the guiding element 109 in the radial direction. As does the first and second holding surfaces 122, 121, the first and second retaining faces 125*a*, 125*b* also advantageously exhibit axial surfaces in this embodiment.

As can be appreciated from FIG. 8 and FIG. 9, the shown tree spool 119 also has outwardly extending profiles 123. Thus, by inverting the inclination of the guiding surfaces 111, 113 in order to move the dog 105 radially inward with respect to the main body 115 and the activation sleeve 101 when locking, the connector assembly could easily be adjusted to be connectable to the outwardly extending profiles 123 of a tree spool. Of course, the diameter of the connector assembly 100 would have to be adjusted to fit around the tree spool 119, as is evident for a person skilled in the art.

Furthermore, as appreciated by a person skilled in the art, one could also adjust the connector assembly 100 in such way that an upward movement of the activation sleeve would force locking dogs into locking engagement, instead of a downwardly directed movement.

Figure 11:
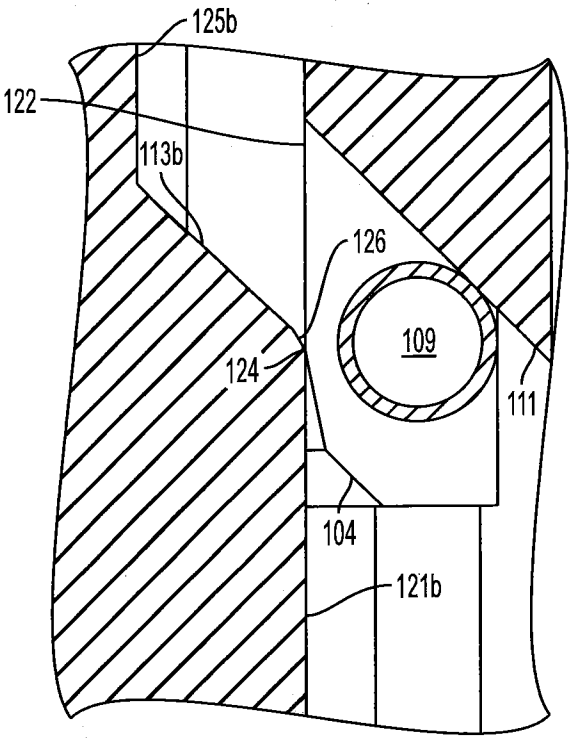
FIG. 11 is an enlarged cross section view showing details of the position shown in FIG. 10.
Figure 10:
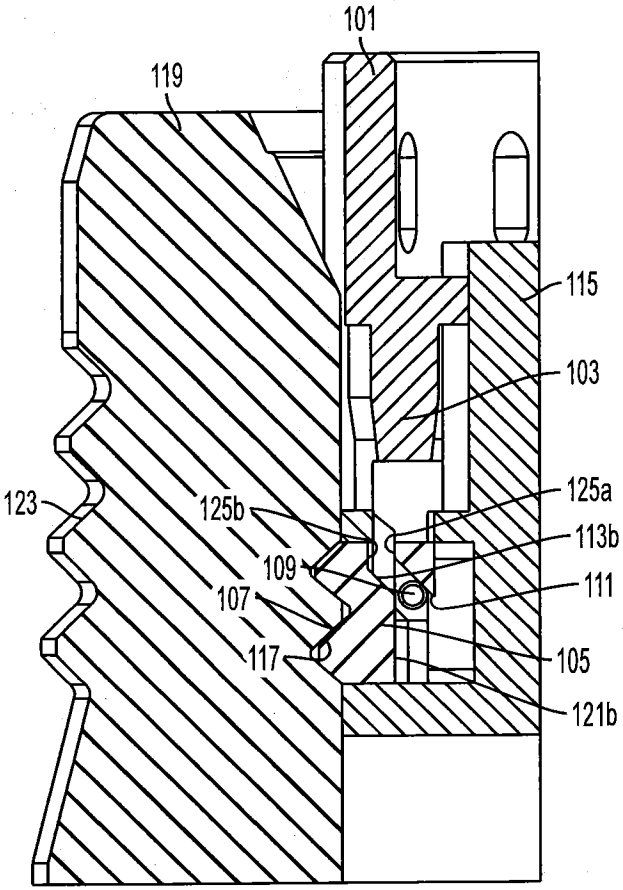
FIG. 10 is the same view as in FIG. 8, wherein the connector assembly is in an intermediate position between locked and unlocked position.

FIG. 10 show the same cross section view as FIG. 8 and FIG. 9, however with the activation sleeve 101 in an intermediate position between the locked and the unlocked positions. FIG. 11 is an enlarged cross section view of FIG. 10, and shows an advantageously embodiment of the present invention in detail. In the position shown in FIG. 11 (and FIG. 10), the guiding element 109 is moved in the second direction (upwards) and has just come into contact with the inclined unlocking surface 111 of the locking dog 105. In this position, the first holding surface 122 of the activation sleeve no longer has contact with the second holding surface 121 (In FIG. 11, this surface is illustrated by the reference number 121*b*, since the cross section runs through the side part of the locking dog 105) of the locking dog 105. Instead, a pre-tension transition surface 124 defining the transition between the first holding surface 122 and the inclined locking surface 104 of the activation sleeve 101, slides against a pre-tension transition surface 126 of the locking dog 105. During this movement, any pre-tensioning towards the locking direction DL will be released, at least to some extent, before the guiding element 109 meets the inclined unlocking surface 111. In FIG. 5, the pre-tension transition surface 124 is depicted as an edge, however, as laid out above, it is preferably a surface.

The pre-tension transition surfaces 124, 126 also have advantage when moving the locking dog 105 in the locking direction DL. In this case, the inclined locking surface 113 may function as a sliding surface for moving the locking dog 105 into the locking position, whereas the pre-tension transition surfaces 124, 126 can function as pre-tensioning surfaces. That is, when the locking dog 105 has moved into the locked position by sliding against inclined locking surface 104 on the activation sleeve 101, the sliding of the pre-tension transition surface 124 of the activation sleeve 101 against the pre-tension transition surface 126 of the locking dog 105 will provide for pre-tensioning of the locking dog 105. As will be appreciated by the person skilled in the art, the lower degree of inclination of the pre-tension transition surfaces 124, 126 is advantageous in order to achieve high forces in the locking direction DL.

Figures 12, 13:
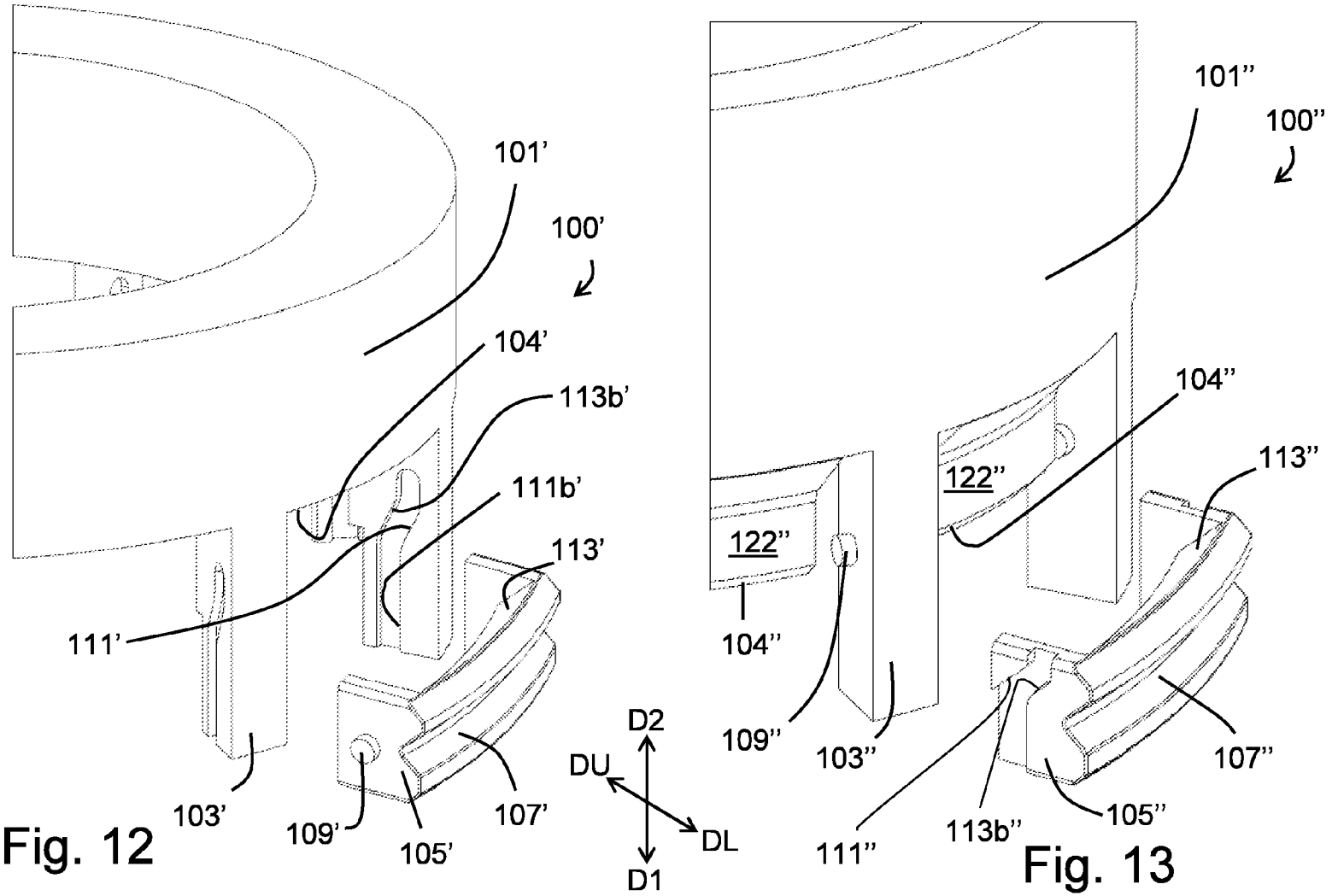
FIG. 12 is a cross section view illustrating an alternative embodiment of the invention.
FIG. 13 is a cross section view illustrating another alternative embodiment of the invention.

FIG. 12 and FIG. 13 illustrate alternative embodiments of the present invention. In both embodiments, the activation sleeve protrusions 103', 103" do not extend into pockets in the locking dogs. Instead, the extend between the locking dogs 105', 105". Thus, as can be seen from the two variations shown in these figures, the guiding elements 109', 109" can either extend out from the locking dogs 105' or out from the activation sleeve protrusions 103". As result, the inclined unlocking guiding surfaces 111', 111" are arranged in the opposite part, either in the activation sleeve protrusions 103' or the locking dogs 105", respectively.

An especially advantageous feature of the connector assembly according to the embodiment illustrated in the drawings, is that by moving the guiding elements 109 upwards and out of or past the space between the retaining faces 125*a*, 125*b* (referring to the embodiment according to FIG. 1 to FIG. 11), the dogs 105 can be removed from the connector assembly 100 without any further preparations or dismantling operations. By arranging the guiding elements 109 in a position adjacent to the second axial holding surface 121, as shown in FIG. 9, this can also take place. The locking dogs 105 can be taken out through the activation sleeve windows 106 (FIG. 1).

In order to keep the dogs 105 in place when the connector assembly 100 is not in use, the guiding elements 109 should be arranged as shown in FIG. 8, wherein the first and second retaining surfaces 125*a*, 125*b* retains the locking dog 105 from moving in the locking or unlocking direction DL, DU. However, the dogs 105 could easily also be arranged with a second axial surface (not shown) opposite of the axial holding surface 121, such that the dogs 105 stay in place in the connector assembly 100 provided that the guiding elements 109 are arranged within the top and the bottom ends of the dogs 105. Such an embodiment is shown with the set-up shown in FIG. 12. In this embodiment, the activation sleeve 101 must be lifted out of engagement with the guiding elements 109' in order to remove the locking dogs 105' from the connector assembly 100'.

Thus, the dogs 105, being parts which may be exposed to large forces and thereby may suffer wearing, can be easily replaced. One could also imagine such replacement being necessary in order to arrange dogs with locking profiles 107 of a different design or material. Also, one may want to replace the dogs in order to change them into dogs with another inclination of the unlocking and/or locking guiding surface 111, 113.

The number of locking elements or dogs 105 arranged peripherally about the connector assembly should preferably be two or more, for instance four, six, or eight. This number and the particular design of the locking elements should be chosen by the skilled person according to use and requirements.

Moreover, in the embodiments described with reference to the drawings, the activation sleeve 101 moves in a direction perpendicular to the movement of the dogs 105. However, as will be appreciated by a person skilled in the art, the direction of the dogs 105 can indeed be non-perpendicular in relation to the moving direction of the sleeve.

In a further variation of the embodiment described above, the activation sleeve 101 can be replaced by separate activation means. For instance, each dog 105 can be connected to a separate activation means, or a plurality, but not all dogs, can be connected to a common activation means.

It should also be noted that the connector assembly according to the invention is not restricted to subsea well elements, such as the tree spool in the above embodiments. On the contrary, it is applicable in a wide range of technical areas, onshore and offshore.

LIST OF REFERENCE NUMBERS

D1 first direction
D2 second direction
DL locking direction
DU unlocking direction
100 connector assembly
101 activation sleeve
102 activation sleeve spaces (or cut-outs)
103 activation sleeve protrusions
104 inclined locking surface (on activation sleeve)
105 locking element
106 activation sleeve window
107 locking profiles (on locking element)
108 bolts
109 guiding element
110 side walls (of locking elements)

111 inclined unlocking guiding surfaces (on sleeve OR locking element)
113 inclined locking surface (on locking element)
113*b* (the narrow inclined guiding surface, opposite 111)
115 ITC
117 (internal) locking profiles on tubular member
119 tubular member (e.g. tree spool)
121 second holding surface (on locking element)
122 first holding surface (on activation sleeve)
123 external locking profiles on tubular member
124 pre-tension transition surface (on activation sleeve)
125*a* first retaining face (on locking element)
125*b* second retaining face (on locking element)
126 pre-tension transition surface (on locking element)
301 ITC
303 ring
305 locking ring.

The invention claimed is:

1. A connector assembly comprising:

a locking element that is movable in a locking direction and an opposite unlocking direction, the locking element comprising a first locking profile for locking engagement with a second locking profile formed on a tubular member;

an activation sleeve operatively coupled to the locking element;

an inclined locking surface disposed on at least one of the locking element and the activation sleeve;

an inclined unlocking surface disposed on at least one of the locking element and the activation sleeve;

a guiding element disposed on at least one of the locking element and the activation sleeve, the guiding element in sliding engagement with the inclined unlocking surface;

a plurality of axially extending activation sleeve protrusions extending from the activation sleeve, a space being formed between adjacent activation sleeve protrusions of the plurality of axially extending activation sleeve protrusions;

wherein the locking element is moved in the locking direction responsive to movement of the activation sleeve in a first direction;

wherein movement of the activation sleeve in a second direction results in movement of the locking element in the opposite unlocking direction; and wherein the locking element comprises a plurality of rearwardly extending side walls defining a void therebetween, wherein an axially extending activation sleeve protrusion of the plurality of axially extending activation sleeve protrusions extends into the void.

2. The connector assembly according to claim 1, wherein disengagement of the guiding element from the inclined unlocking surface facilitates removal of the locking element from the connector assembly.

3. The connector assembly according to claim 1, wherein:

the inclined locking surface is disposed on the activation sleeve and comprises an inclination to said first direction and said locking direction;

the inclined locking surface slides against a second facing inclined locking surface formed on the locking element; and when the activation sleeve is moved in the first direction, the locking element is moved in the locking direction.

4. The connector assembly according to claim 3, wherein:

the locking element comprises a second holding surface which is substantially perpendicular to the locking direction and the unlocking direction; and the activation sleeves comprise a first holding surface that abuts against the second holding surface when the locking element is in a locked position.

5. The connector assembly according to claim 4, wherein:

the first holding surface and the second holding surface are arranged to maintain a pre-tension of the locking element towards the locking direction;

at least one pre-tension transition surface is arranged between at least one of the inclined locking surface and the second facing inclined locking surface and at least one of the second holding surface and the first holding surface; and the pre-tension transition surface is arranged such that pre-tension is at least partially released before the guiding element engages the inclined unlocking surface when the activation sleeve is moved in the second direction.

6. The connector assembly according to claim 1, wherein:

the activation sleeve comprises a plurality of pre-tension transition surfaces that slidably engage a second facing pre-tension transition surface formed on the locking element as the activation sleeve is moved further in the first direction; and the movement of the activation sleeve in the first direction results in the plurality of pre-tension transition surfaces sliding against the second pre-tension transition surface of the locking element, creating a pre-tension compression force between the activation sleeve and the locking element.

7. The connector assembly according to claim 1, comprising a first pre-tension transition surface formed on the activation sleeve and a second pre-tension transition surface formed on the locking element;

wherein the first pre-tension transition surface and the second pre-tension transition surface provide pre-tension of the locking element in the locking direction as the first pre-tension transition surface and the second pre-tension transition surface slide against each other when the activation sleeve is moved in the first direction; and wherein the first pre-tension transition surface and the second pre-tension transition surface comprise an angle of inclination between and different from an angle of the inclined locking surface and the first direction.

8. A connector assembly comprising:

a locking element that is movable in a locking direction and an opposite unlocking direction, the locking element comprising a first locking profile for locking engagement with a second locking profile formed on a tubular member;

an activation sleeve operatively coupled to the locking element;

an inclined locking surface disposed on at least one of the locking element and the activation sleeve;

an inclined unlocking surface disposed on at least one of the locking element and the activation sleeve;

a guiding element disposed on at least one of the locking element and the activation sleeve, the guiding element in sliding engagement with the the inclined unlocking surface;

a plurality of axially extending activation sleeve protrusions extending from the activation sleeve, a space being formed between adjacent activation sleeve protrusions of the plurality of axially extending activation sleeve protrusions;

wherein the locking element is moved in the locking direction responsive to movement of the activation sleeve in a first direction;

wherein movement of the activation sleeve in a second direction results in movement of the locking element in the opposite unlocking direction; and wherein the locking element is arranged between adjacent axially extending activation sleeve protrusions of the plurality of axially extending activation sleeve protrusions.

9. The connector assembly according to claim 8, wherein disengagement of the guiding element from the inclined unlocking surface facilitates removal of the locking element from the connector assembly.

10. The connector assembly according to claim 8, wherein:

the inclined locking surface is disposed on the activation sleeve and comprises an inclination to said first direction and said locking direction;

the inclined locking surface slides against a second facing inclined locking surface formed on the locking element; and when the activation sleeve is moved in the first direction, the locking element is moved in the locking direction.

11. The connector assembly according to claim 10, wherein:

the locking element comprises a second holding surface which is substantially perpendicular to the locking direction and the unlocking direction; and the activation sleeves comprise a first holding surface that abuts against the second holding surface when the locking element is in a locked position.

12. The connector assembly according to claim 11, wherein:

the first holding surface and the second holding surface are arranged to maintain a pre-tension of the locking element towards the locking direction;

at least one pre-tension transition surface is arranged between at least one of the inclined locking surface and the second facing inclined locking surface and at least one of the second holding surface and the first holding surface; and the pre-tension transition surface is arranged such that pre-tension is at least partially released before the guiding element engages the inclined unlocking surface when the activation sleeve is moved in the second direction.

13. The connector assembly according to claim 8, wherein the activation sleeve comprises a plurality of pre-tension transition surfaces that slidably engage a second facing pre-tension transition surface formed on the locking element as the activation sleeve is moved further in the first direction; and the movement of the activation sleeve in the first direction results in the plurality of pre-tension transition surfaces sliding against the second pre-tension transition surface of the locking element, creating a pre-tension compression force between the activation sleeve and the locking element.

14. The connector assembly according to claim 8, comprising a first pre-tension transition surface formed on the activation sleeve and a second pre-tension transition surface formed on the locking element;

wherein the first pre-tension transition surface and the second pre-tension transition surface provide pre-tension of the locking element in the locking direction as the first pre-tension transition surface and the second pre-tension transition surface slide against each other when the activation sleeve is moved in the first direction; and wherein the first pre-tension transition surface and the second pre-tension transition surface comprise an angle of inclination between and different from an angle of the inclined locking surface and the first direction.

* * * * *